US005816145A

United States Patent [19]

Lackner

[11] Patent Number: 5,816,145

[45] Date of Patent: Oct. 6, 1998

[54] TRASH COMPACTOR

[75] Inventor: Raymond F. Lackner, Pittsburgh, Pa.

[73] Assignee: Daniel Glosser, TDBA Glosser Manufacturing Co., McKeesport, Pa.

[21] Appl. No.: 853,112

[22] Filed: May 8, 1997

[51] Int. Cl.[6] ..... B30B 7/02

[52] U.S. Cl. ..... 100/208; 100/229 A; 100/295

[58] Field of Search ..... 100/185, 193, 100/208, 295, 229 A; 414/512, 525.2, 525.55, 525.6

[56] References Cited

U.S. PATENT DOCUMENTS

| | | | |
|---|---|---|---|
| Re. 29,278 | 6/1977 | Vogel | 100/295 |
| 3,368,478 | 2/1968 | Clar | 100/229 A |
| 3,893,386 | 7/1975 | Wise | 100/229 A |
| 4,158,332 | 6/1979 | Melandri | 100/185 |
| 4,374,491 | 2/1983 | Stortroen et al. | 100/229 A |
| 4,557,658 | 12/1985 | Lutz | 100/193 |
| 4,576,540 | 3/1986 | Derain et al. | 100/295 |
| 5,181,463 | 1/1993 | Lackner | 100/193 |
| 5,377,584 | 1/1995 | Egretier | 100/185 |

FOREIGN PATENT DOCUMENTS

| | | | |
|---|---|---|---|
| 0080719 | 6/1983 | European Pat. Off. | 100/229 A |
| 52-77474 | 6/1977 | Japan | 100/229 A |
| 54-109261 | 8/1979 | Japan | 100/229 A |

*Primary Examiner*—Stephen F. Gerrity
*Attorney, Agent, or Firm*—George Raynovich, Jr.

[57] ABSTRACT

A trash compactor is provided that has a single ram that simultaneously precompacts trash in an auxiliary precompacting chamber and compacts trash that already has been precompacted in a main compacting and storage chamber. The ram has a single actuating device and has first and second parts which are both actuated by the single actuating device. Latches are provided to latch the two ram parts together and also to latch one of the ram parts to the wall of the trash compactor during various times during the compacting cycle of the ram.

20 Claims, 4 Drawing Sheets

TRASH COMPACTOR

BACKGROUND OF THE INVENTION

1. Field of the Invention

This invention relates to trash compactors and more particularly, to trash compactors having a two stage compacting process with a single ram for compacting in both stages.

2. Description of the Prior Art

Collecting and transporting trash from urban areas has become a major industry throughout the civilized world. Because trash must be transported from urban areas to areas where it can be left in landfills or otherwise disposed of, an important function in transporting trash is to first compact it so as to reduce the volume required to transport a given weight of waste material.

Trash compactors have been utilized in trash transfer stations where trash is brought by vehicles that collect it in urban areas and reprocessed and placed on larger vehicles for long haul transportation to remote landfills or other disposal locations. The trash compactor of the present invention contemplates an efficient two stage compacting device in which a single ram compresses and compacts trash material in both stages of compaction.

Trash compactors are well known. U.S. Pat. No. 3,355,044, U.S. Pat. No. 3,454,174, U.S. Pat. No. 4,014,988 and U.S. Pat. No. 4,113,125 are all examples of well known trash compactors. Other examples of compactors are shown in U.S. Pat. No. 3,638,561 and U.S. Pat. No. 4,757,758. Multistage trash compactors are also known as evidenced by U.S. Pat. No. 3,908,538.

My earlier U.S. Pat. Nos. 5,181,463 and 5,193,455 describe and claim a trash compactor with a single actuated ram that has two parts for relative motion to each other. In the trash compactor with a single two-part ram, it has been found that occasionally material being compacted will jam between the two parts of the single actuated ram so that the two parts do not move relative to each other as desired. In order to alleviate this condition, I have improved the two-part ram of my trash compactor by strategically positioning latches that connect the two parts of the ram to each other or to the wall of the compactor during certain operations and automatically disconnect the latched parts during other operations.

SUMMARY OF THE INVENTION

In accordance with the present invention, there is provided a trash compactor having a main compacting and storage chamber with a side opening to receive trash, an auxiliary precompacting chambers selectively communicating with the main compacting and storage chamber and a two part ram having a first part that compacts material within the main compacting and storage chamber and a second part that compacts material within the auxiliary chamber. The two part ram has a first part retractable below the second part when the ram is retracted horizontally away from the main compacting and storage chamber by a hydraulic piston and cylinder fixed to the ram first part and also fixed to the body of the trash compactor. The trash compactor is improved by providing a first latch fixed to the ram second part and engageable with the trash compactor body when the ram second part is completely retracted away from the main compacting and storage chamber. A latch release is slidably secured to the ram second part and operates to release the first latch when the ram first part moves to a position that the ram first part abuts the latch release thereby permitting the ram second part to move toward the main compacting and storage chamber as the ram first part is advanced toward the main compacting and storage chamber. A second latch is fixed to the ram second part and engageable with the ram first part when the ram first part is advanced horizontally toward the main compacting and storage chamber so that when the ram first part is initially retracted away from the ram compacting and storage chamber the ram first part and the ram second part move as a unit. A probe is fixed to the trash compactor body to release the second latch when the ram second part has been retracted to a position set by the probe so that the ram first part is retracted relative to the ram second part as the hydraulic piston and cylinder continues to retract the ram first part away from the main compacting and storage chamber.

Accordingly, an object of the present invention is to provide an improved trash compactor having a two-part ram in which the two parts of the ram may be connected by a latch and in which one of the parts of the ram may be connected to the compactor body by a latch.

Another object of the present invention is to provide latches with automatic releases so that the latches may sequentially be latched and unlatched as required by movement of the two-part ram.

These and other objects of the present invention will become more completely disclosed and described in the following specification, accompanying drawings and the appended claims.

DESCRIPTION OF THE PREFERRED EMBODIMENT

Figure 1:
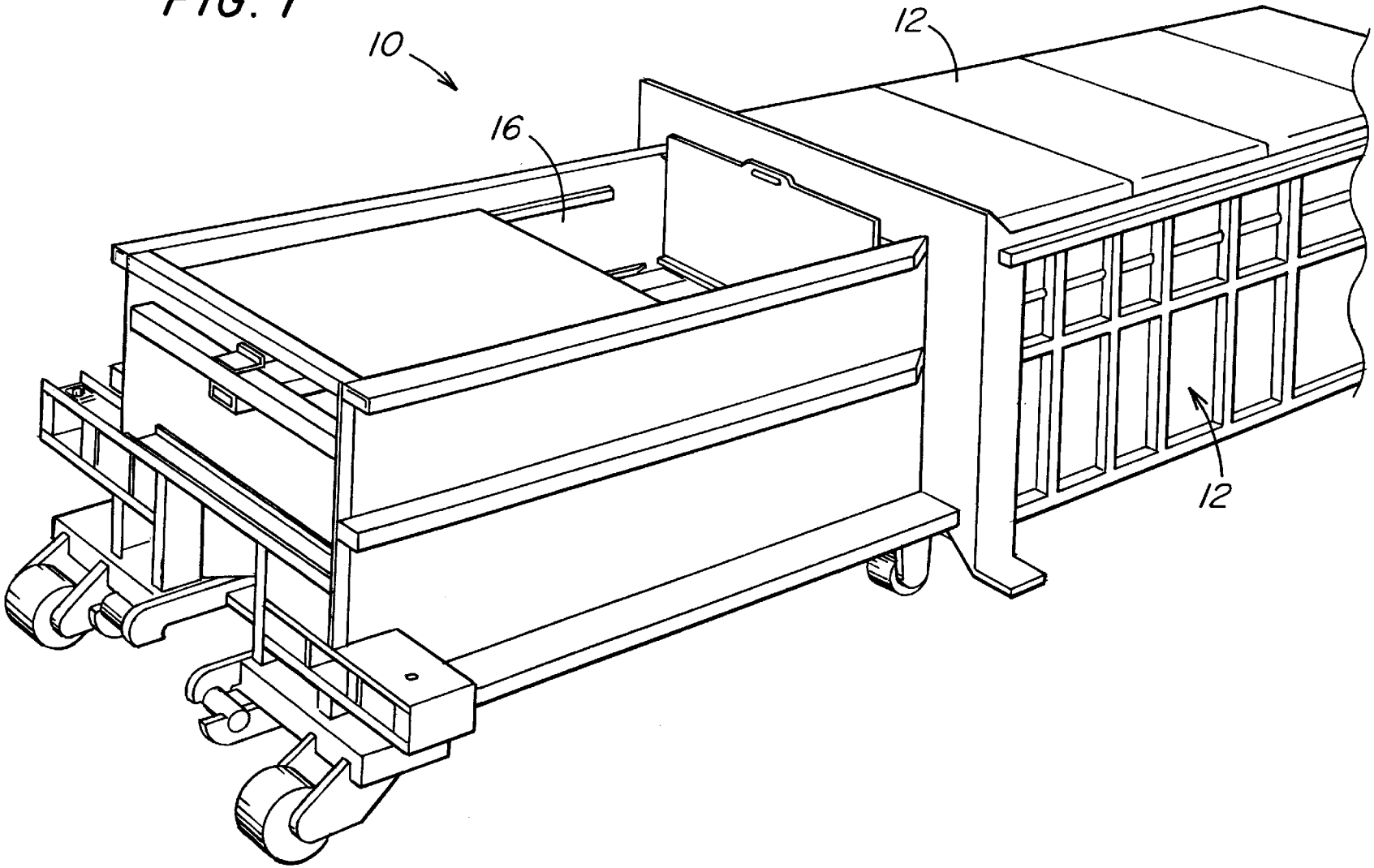
FIG. 1 is a perspective view of the trash compactor of the present invention.

Referring to the drawings, there is shown a trash compactor 10 having a main compacting and storage chamber 12 with a side opening 14 in the main compacting and storage chamber 12. A precompacting chamber 16 is positioned outside the main storage and compacting chamber 12. The main compacting and storage chamber 12 may be a removable unit which, when filled, can be hauled away and a new unit 12 substituted to receive additional trash material. As best seen in FIGS. 2, 4, 5 and 6, a two part ram has a first part 18 and second part 20. A piston and cylinder arrangement 22 is connected to the rear wall of the trash compactor 10 and drives the ram first part 18 horizontally in a reciprocal motion to compact trash and to retract the ram first part 18.

A first latch 26 is secured to the rear end of the ram second part 20. Details of the first latch 26 may be seen by reference to FIG. 3. The first latch 26 connects to a latch bar 28 (FIG.

4) that extends horizontally across the trash compactor body so that when latch 26 engages latch bar 28 the ram second part 20 is secured to the trash compactor.

Figure 3:
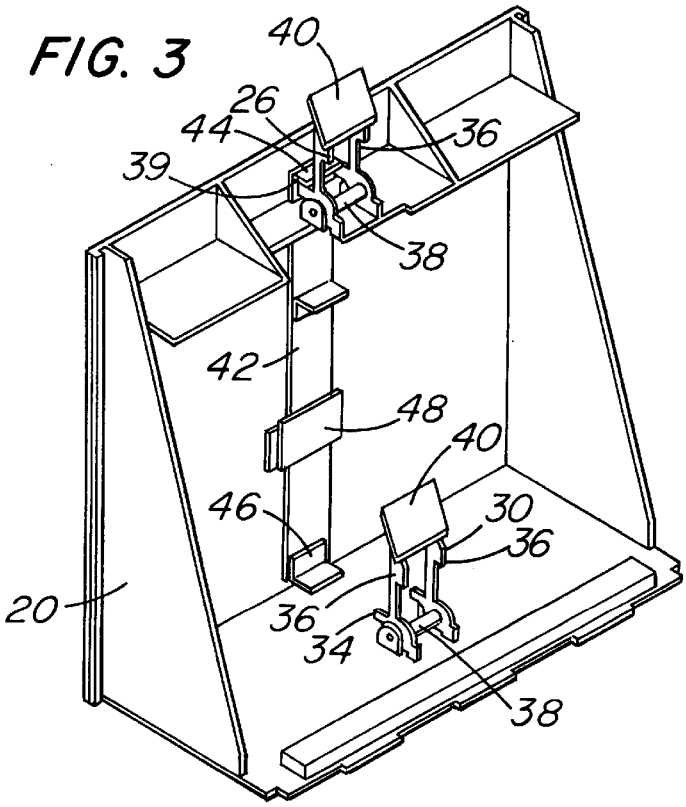
FIG. 3 is a perspective view of the underside of the second part of the two-part ram showing details of the latch mechanisms.

A second latch 30 is secured to the front wall of ram second part 20 as may be seen FIG. 3. The second latch 30 connects to a latch plate 32 (FIG. 4) that is secured to an upstanding frame 34 fixed to ram first part 18.

The first latch 26 and the second latch 30 are identical in construction. Each has latch hooks 36 (FIG. 3) and is pivoted on a pivot pin 38. Latch release ears 39 extend upwardly from the latch hooks 36 near the pivot pin 38. Each of the latches 26 and 30 have engaging plates 40 which extend at an angle to the latch hooks 36 and facilitate latching and unlatching of the latches when the plates 40 contact the latch bar 28 or the latch plate 32.

A latch release 42 (FIG. 3) has a release claw 44 and a release contact 46 formed thereon. A strap 48 holds latch release 42 to the underside of ram second part 20 so that latch release 42 may slide relative to the ram second part 20.

A probe 50 is fixed to the rear wall 24 of the trash compactor 10 to release the second latch 30 as will be described.

Figure 2:
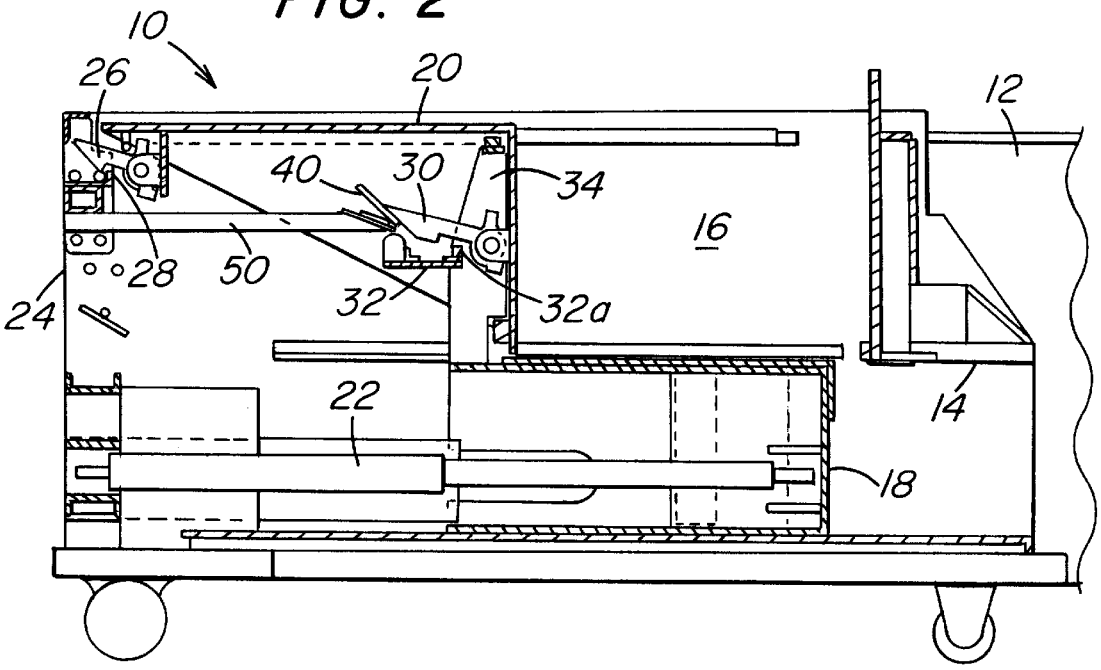
FIG. 2 is a sectional view of the trash compactor of FIG. 1 showing the two-part ram and the hydraulic piston and cylinder actuator when the ram is in the load position.

In operation, the ram first part 18 and the ram second part 20 are positioned in the load position shown in FIG. 2. In that position, both latch 26 and latch 30 are released and material to be compacted is positioned within the precompacting chamber 16 above the ram first part 18. The ram first part 18 is driven by piston and cylinder unit 22 to the right as viewed in FIG. 2 until the upstanding frame 34 on ram first part 18 is engaged with the front wall of ram second part 20 so that the two ram parts 18 and 20 move to the right, as viewed in FIG. 2, in unison.

Figure 5:
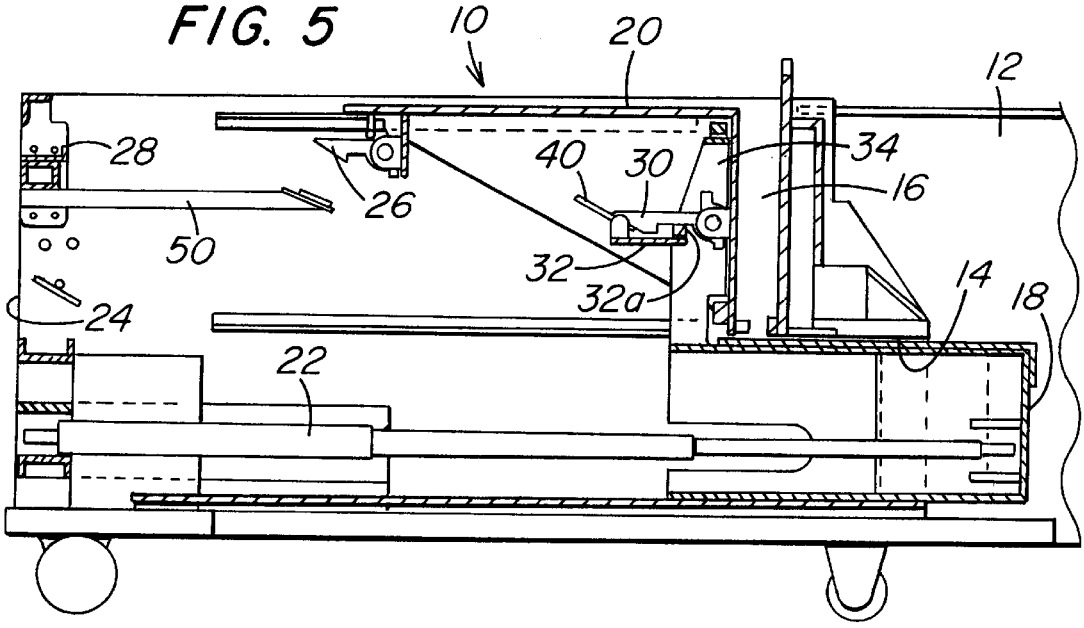
FIG. 5 is a sectional view similar to FIGS. 1 and 4 showing the ram fully extended.

As shown in FIG. 5, the ram parts 18 and 20 are fully extended by the piston and cylinder unit 22. At that point it will be seen that the precompacting chamber 16 has been reduced in volume to compact material that has been placed therein. As the ram first part 18 moved to the right as viewed in FIGS. 2 and 5 from the position shown in FIG. 2 to the position shown in FIG. 5, the latch 30 was contacted by the upstanding portion 32*a* of latch plate 32 so that latch 30 connected the ram first part 18 to the ram second part 20 for movement in unison.

Figure 4:
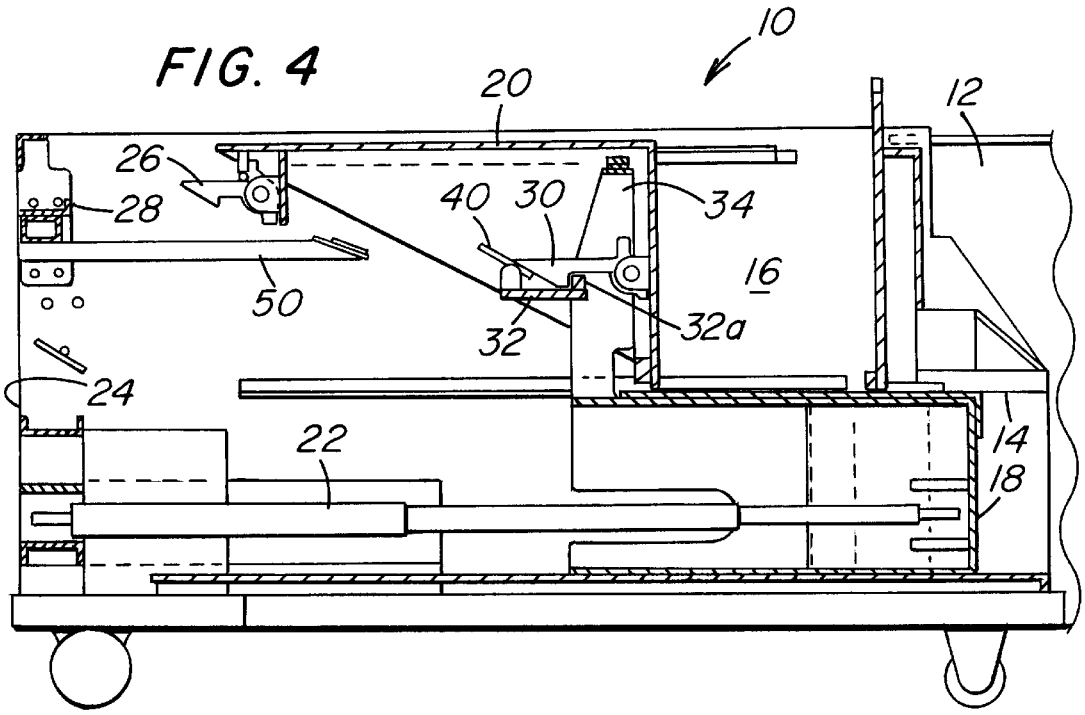
FIG. 4 is a sectional view similar to FIG. 2 showing the two-part ram being retracted.

Referring to FIG. 4, after the ram has been fully extended by piston and cylinder unit 22 as shown in FIG. 5, the piston and cylinder unit 22 retracts the ram first part 18 and since the latch 30 is latched, both the ram first part 18 and the ram second part 20 move as a unit toward the left as viewed in FIG. 4.

Figure 6:
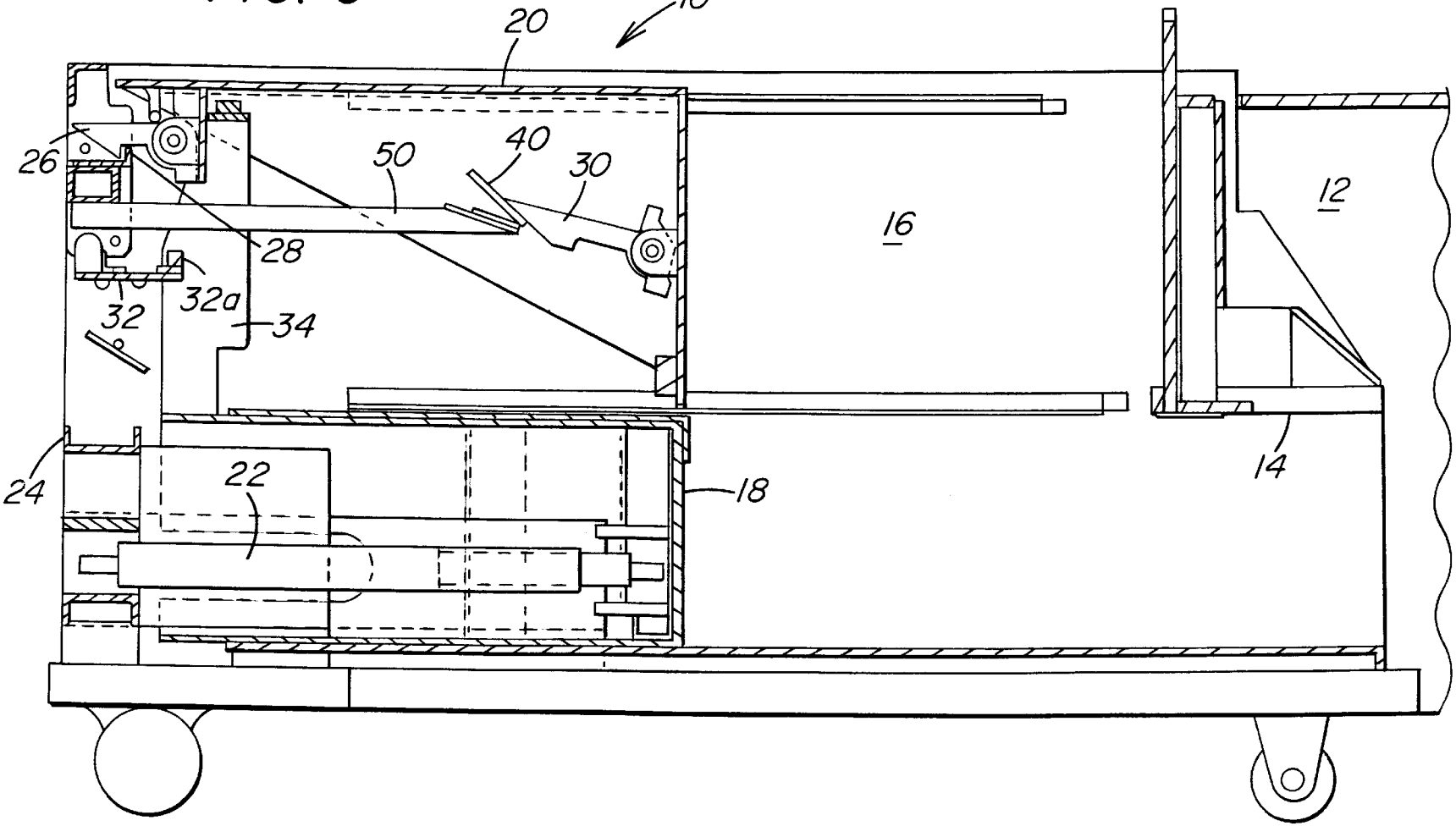
FIG. 6 is a sectional view similar to FIGS. 2, 4 and 5 showing the ram fully retracted.

FIG. 6 shows the ram first part 18 and the ram second part 20 both in the fully retracted position. In that position, the material that has been precompacted in precompacting chamber 16 drops down so that it will then be contacted by ram first part 18 on the next stroke and compacted within the main compacting and storage chamber 12. As seen in FIG. 6, when the ram first part 18 and the ram second part 20 are moved to the left, the probe 50 contacts the engaging plate 40 of second latch 30 and releases that latch 30 so that the ram first part 18 and the ram second part 20 can move independently of each other. At the same time, when ram second part 20 is fully retracted, the first latch 26 latches with the latch bar 28 to restrain ram second part 20 in the position shown in FIG. 6 until latch 26 is released.

From the position shown in FIG. 6, when the piston and cylinder unit 22 is actuated to move the ram first part 18 to the right as viewed in FIG. 6, the ram first part 18 moves independently until the upstanding frame 34 on ram first part 18 contacts the release contact 46 on latch release 42 (FIG. 3) thereby moving the latch release 42 so that the release claw 44 on latch release 42 contacts the release ears 39 on latch 26 to pivot latch 26 and release it to permit the ram second part 20 to move with the ram first part 18 to the right as viewed in FIGS. 2, 4, 5 and 6.

In some instances, it may be desirable to have several precompacting cycles of the material in precompacting chamber 16 before the ram is fully retracted to permit the precompacted material to drop down in front of ram first part 18. In such an instance, the latch 30 remains engaged so that the ram first part 18 and the ram second part 20 reciprocate as a unit to precompact the material in precompacting chamber 16.

It may be seen that by having latches 26 and 30 operate, the desired movement of ram first part 18 and ram second part 20 can be guaranteed. No trash or debris can cause the ram first part 18 and the ram second part 20 to jam together so that they fail to move forward together and fail to retract appropriately.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. In a trash compactor having a main compacting and storage chamber with a side opening to receive trash, an auxiliary precompacting chamber selectively communicating with said main compacting and storage chamber, a two-part ram having a first part that compacts material within said main compacting and storage chamber and a second part that compacts material within said auxiliary chamber, said two-part ram having said ram first part retractable below said ram second part when said ram is retracted horizontally away from said main compacting and storage chamber by a hydraulic piston and cylinder fixed to said ram first part and the body of said trash compactor, the improvement comprising:

a latch fixed to said ram second part and engageable with said trash compactor body when said ram second part is completely retracted away from said main compacting and storage chamber;

a latch release slidably secured to said ram second part and operable to release said latch when said ram first part moves to a position that said ram first part abuts said latch release thereby permitting said ram second part to move toward said main compacting and storage chamber as said ram first part is advanced toward said main compacting and storage chamber.

2. The trash compactor of claim 1 wherein said latch has a movable part fixed to said ram second part that latches with an immovable latch bar fixed to said trash compactor body.

3. The trash compactor of claim 2 wherein said latch release contacts said latch movable part to release said latch when said ram first part abuts said latch release.

4. The trash compactor of claim 2 wherein said latch movable part automatically engages said immovable latch bar when said latch movable part contacts said latch bar.

5. The trash compactor of claim 1 wherein said latch release includes a bar slidably secured to said ram second part.

6. In a trash compactor having a main compacting and storage chamber with a side opening to receive trash, an auxiliary precompacting chamber selectively communicating with said main compacting and storage chamber, a two-part ram having a first part that compacts material within said main compacting and storage chamber and a second part that compacts material within said auxiliary chamber, said two-part ram having said ram first part retractable below said ram second part when said ram is retracted horizontally away from said main compacting and storage chamber by a hydraulic piston and cylinder fixed to said ram first part and the body of said trash compactor, the improvement comprising:

a latch fixed to said ram second part and engageable with said ram first part when said ram first part is advanced horizontally toward said main compacting and storage chamber so that when said ram first part is initially retracted horizontally away from said main compacting and storage chamber, said ram first part and said ram second part move as a unit;

a probe fixed to said trash compactor body to release said latch when said ram second part has been retracted to a position set by said probe so that said ram first part is retracted relative to said ram second part as said hydraulic cylinder continues to retract said ram first part away from said main compacting and storage chamber.

7. The trash compactor of claim 6 wherein said latch has a movable part fixed to said ram second part that latches with an immovable latch plate fixed to said ram first part.

8. The trash compactor of claim 7 wherein said probe contacts a sloped surface on said latch movable part to release said latch.

9. The trash compactor of claim 7 wherein said latch movable part automatically engages said immovable latch plate when said latch movable part contacts said immovable latch bar.

10. The trash compactor of claim 6 wherein said probe is fixed to a rear wall of said trash compactor body.

11. In a trash compactor having a main compacting and storage chamber with a side opening to receive trash, an auxiliary precompacting chamber selectively communicating with said main compacting and storage chamber, a two-part ram having a first part that compacts material within said main compacting and storage chamber and a second part that compacts material within said auxiliary chamber, said two-part ram having said ram first part retractable below said ram second part when said ram is retracted horizontally away from said main compacting and storage chamber by a hydraulic piston and cylinder fixed to said ram first part and the body of said trash compactor, the improvement comprising:

a first latch fixed to said ram second part and engageable with said trash compactor body when said ram second part is completely retracted away from said main compacting and storage chamber;

a latch release slidably secured to said ram second part and operable to release said first latch when said ram first part moves to a position that said ram first part abuts said latch release thereby permitting said ram second part to move toward said main compacting and storage chamber as said ram first part is advanced toward said main compacting and storage chamber;

a second latch fixed to said ram second part and engageable with said ram first part when said ram first part is advanced horizontally toward said main compacting and storage chamber so that when said ram first part is initially retracted horizontally away from said main compacting and storage chamber, said ram first part and said ram second part move as a unit;

a probe fixed to said trash compactor body to release said second latch when said ram second part has been retracted to a position set by said probe so that said ram first part is retracted relative to said ram second part as said hydraulic piston and cylinder continues to retract said ram first part away from said main compacting and storage chamber.

12. The trash compactor of claim 11 wherein said first latch has a movable part fixed to said ram second part that latches with an immovable latch bar fixed to said trash compactor body.

13. The trash compactor of claim 12 wherein said latch release contacts said first latch movable part to release said latch when said ram first part abuts said latch release.

14. The trash compactor of claim 12 wherein said first latch movable part automatically engages said immovable latch bar when said first latch movable part contacts said latch bar.

15. The trash compactor of claim 11 wherein said latch release includes a bar slidably secured to said ram second part.

16. The trash compactor of claim 11 wherein said second latch has a movable part fixed to said ram second part that latches with an immovable latch plate fixed to said ram first part.

17. The trash compactor of claim 16 wherein said probe contacts a sloped surface on said second latch movable part to release said second latch.

18. The trash compactor of claim 16 wherein said second latch movable part automatically engages said immovable latch plate when said second latch movable part contacts said immovable latch plate.

19. The trash compactor of claim 11 wherein said probe is fixed to a rear wall of said trash compactor body.

20. The trash compactor of claim 11 wherein said first latch and said second latch have the same configuration.

* * * * *